US010226818B2

(12) United States Patent
Scalzo et al.

(10) Patent No.: US 10,226,818 B2
(45) Date of Patent: Mar. 12, 2019

(54) PROCESS FOR JOINING POWDER INJECTION MOLDED PARTS

(75) Inventors: Orlando Scalzo, Montreal (CA); Marc Campomanes, Longueuil (CA); Melissa Despres, Verdun (CA); Alain Bouthillier, Sainte-Julie (CA); Vincent Savaria, Laval (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 659 days.

(21) Appl. No.: 12/408,078

(22) Filed: Mar. 20, 2009

(65) Prior Publication Data

US 2010/0236688 A1 Sep. 23, 2010

(51) Int. Cl.
*B22F 3/22* (2006.01)
*B22F 7/06* (2006.01)

(52) U.S. Cl.
CPC ..... *B22F 3/225* (2013.01); *B22F 7/062* (2013.01)

(58) Field of Classification Search
CPC ..... B22F 7/062
USPC ..... 264/656, 657; 156/89.23; 419/54
See application file for complete search history.

(56) References Cited

U.S. PATENT DOCUMENTS 2,957,235 A * 10/1960 Steinberg ..... 29/424
3,351,688 A * 11/1967 Kingery et al. ..... 264/656
4,236,923 A 12/1980 Takahashi et al.
4,499,048 A 2/1985 Hanejko
4,503,009 A 3/1985 Asaka
4,839,138 A 6/1989 Filz
5,021,208 A * 6/1991 Ludwig et al. ..... 264/344
5,028,367 A * 7/1991 Wei et al. ..... 264/656
5,043,123 A 8/1991 Gormanns et al.
5,078,929 A 1/1992 Matsumae et al.
5,271,877 A 12/1993 Matsumae et al.
5,554,338 A 9/1996 Sugihara et al.
5,574,957 A 11/1996 Barnard et al.
5,616,026 A 4/1997 Cash
5,732,323 A 3/1998 Nyrhilä
5,933,733 A 8/1999 Ferla et al.
6,033,788 A 3/2000 Cawley et al.
6,093,761 A * 7/2000 Schofalvi ..... 524/195
6,114,048 A 9/2000 Jech et al.
6,120,727 A 9/2000 Asaka et al.
6,228,508 B1 * 5/2001 Kassanits et al. ..... 428/547
6,322,746 B1 11/2001 LaSalle et al.
(Continued)

FOREIGN PATENT DOCUMENTS

DE 102004057360 6/2006
EP 1296370 3/2003
(Continued)

OTHER PUBLICATIONS

European Search Report for corresponding EP application No. EP10250542, dated Jul. 20, 2010.

*Primary Examiner* — William P Bell
(74) *Attorney, Agent, or Firm* — Norton Rose Fulbright Canada LLP

(57) ABSTRACT

A process for joining two or more powder injection molded parts by preparing at least two green parts from a feedstock including a binder and an injection powder. Placing the two or more green part into intimate contact, and maintaining the two green parts in intimate contact at a position with a linkage between the at least two green parts to produce an interconnected green assembly. Placing the assembly under shape retaining conditions, melting the binder of the interconnected green assembly under shape retaining conditions to produce a seamless body.

21 Claims, 1 Drawing Sheet

(56) References Cited

U.S. PATENT DOCUMENTS

| | | | | |
|---|---|---|---|---|
| 6,399,018 | B1* | 6/2002 | German et al. | 419/2 |
| 6,514,627 | B1 | 2/2003 | Heil et al. | |
| 6,569,380 | B2 | 5/2003 | Lim et al. | |
| 6,599,465 | B1 | 7/2003 | Reppel et al. | |
| 6,676,892 | B2 | 1/2004 | Das et al. | |
| 6,889,419 | B2 | 5/2005 | Reiter, Jr. et al. | |
| 6,973,723 | B2 | 12/2005 | Cagney et al. | |
| 7,146,708 | B2 | 12/2006 | Reiter, Jr. et al. | |
| 7,237,730 | B2 | 7/2007 | Prociw et al. | |
| 7,241,416 | B2 | 7/2007 | Sweetland | |
| 7,713,467 | B2 | 5/2010 | Becker et al. | |
| 2002/0028360 | A1* | 3/2002 | Shaffer et al. | 428/699 |
| 2003/0202897 | A1 | 10/2003 | Clark | |
| 2004/0146424 | A1* | 7/2004 | Nelles et al. | 419/37 |
| 2005/0019199 | A1 | 1/2005 | Li et al. | |
| 2007/0154666 | A1* | 7/2007 | Coonan et al. | 428/34.4 |
| 2008/0199343 | A1* | 8/2008 | Rust et al. | 419/6 |
| 2008/0237403 | A1 | 10/2008 | Kelly et al. | |
| 2009/0130459 | A1* | 5/2009 | Kuenzler et al. | 428/446 |
| 2012/0136400 | A1 | 5/2012 | Julien et al. | |

FOREIGN PATENT DOCUMENTS

| | | | |
|---|---|---|---|
| GB | 2202541 | A * | 9/1988 |
| GB | 2394724 | | 5/2004 |
| GB | 2448031 | | 10/2008 |
| JP | 03039405 | A * | 2/1991 |
| WO | WO00/76697 | | 12/2000 |
| WO | WO2005/030417 | | 4/2005 |
| WO | WO2007/005632 | | 1/2007 |
| WO | WO2007098739 | | 9/2007 |
| WO | WO2008/087064 | | 7/2008 |

* cited by examiner

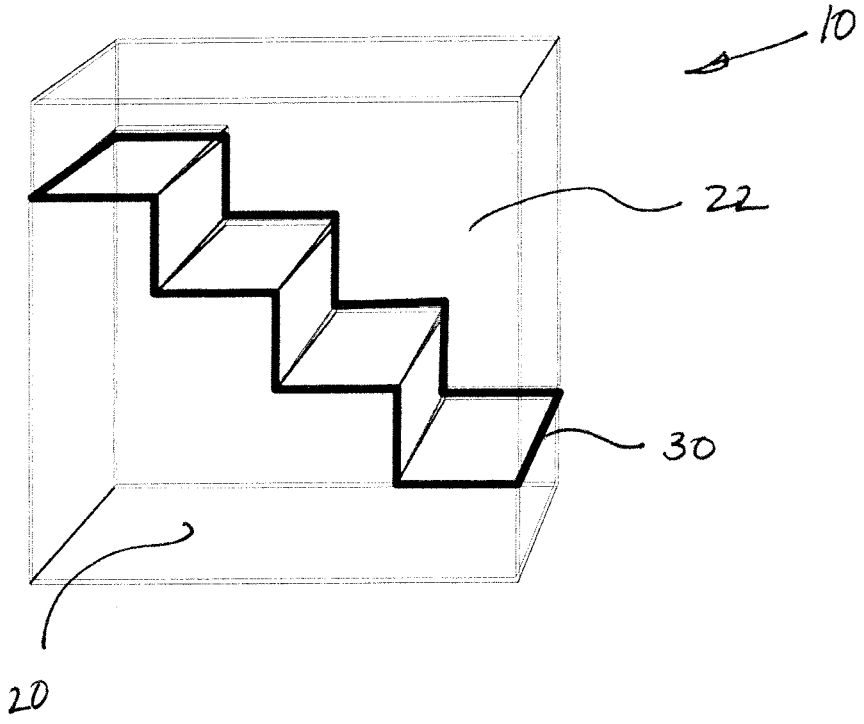
10
22
30
20

PROCESS FOR JOINING POWDER INJECTION MOLDED PARTS

TECHNICAL FIELD

The application relates generally to the joining of powder injection molded parts.

BACKGROUND OF THE INVENTION

Powder injection molding (PIM) can be used to produce complex shaped parts of metal, ceramic and/or carbide materials. PIM involves the homogenization of a feedstock, having at least two components. The two components are: 1) an injection powder which is a finely divided solid particulate, of a material such as, a metal, a ceramic, or carbide, and 2) a binder, that is typically an organic material and may include a lubricant. The feedstock is injected into a mold to produce a green part. This green part is further processed to eliminate the binder in a process of debinding, where a porous and friable brown part is produced. The brown part is sintered to produce the final product that may be in the form of a complex shaped part. Some advantages of powder injection molding are high purity product formation, the ability to repeatedly produce complex final product shapes having close tolerances.

While PIM and metal injection molding (MIM) provide for the manufacturing of complex parts, there is still a need to facilitate joining of two or more PIM parts to enable manufacturing of even more complicated parts.

SUMMARY

In accordance with a general aspect, there is provided a process for joining powder injection molded parts, the method comprising: preparing at least two green parts from a feedstock, the feedstock comprising a binder and an injection powder; placing the at least two green parts in intimate contact; maintaining the at least two green parts in intimate contact at a position with a linkage between the at least two green parts to produce an interconnected green assembly; placing the assembly under shape retaining conditions; and melting the binder while the assembly is maintained under shape retaining conditions to produce a seamless body.

BRIEF DESCRIPTION OF THE DRAWING

FIG. 1 is a schematic perspective view of two green parts joined by a preferred embodiment of the process described herein having a stair-like seam.

DETAILED DESCRIPTION

There will now be described a powder injection molding process, and more particularly a process for joining at least two PIM parts while the same are still in a green state and thereby provide for the production of complex larger parts.

The following terms are defined herein:

A feedstock is a homogeneous mixture of an injection powder (metal, ceramic, glass, carbide) with a binder. The feedstock may be in the form of: i) a particulate feedstock, where the binder is in a solid form, or ii) a molten feedstock, where the binder is in liquid form, and has been typically heated;

The binder is generally an organic material, such as a polymer and may contain additional components such as lubricants or surfactants;

A green part is a molded part produced by a solidified binder that holds the injection powder together; the green part may be at least one of dense, tightly packed, substantially non-porous, and such that any voids between the injection powders particles are filled with solidified binder. Thus, a green part may be engineered to include varying degrees of porosity and still be tightly packed yet have voids filled with a solidified binder;

A brown part is a porous and friable part that is usually defined by an almost complete absence of binder. The brown part is likely held together by some pre-sintering where a degree of pre-sintered injection powder particles are held together by a weak interaction of the particles between spaces formed at points where the binder was originally found. However, in some cases the brown part may also include a residual amount of binder that helps to hold the brown part together before final sintering.

Debinding is a process for the removal of the binder from the green part, and debinding typically produces the brown part. The removal of the binder is done by either heating or dissolution with a solvent;

Sintering is a form of linking finely divided injection powder material of the brown part at a temperatures below their melting point and above one half their melting point (measured in degrees Kelvin, ° K.); and The term co-debinding as used herein, refers to a process, but where at least two green parts are combined to form either a larger seamless green assembly and/or a brown part, that can eventually be sintered completely to form a finished product. The co-debinding product assembly may produce more complex green/brown parts and finished products.

The process of co-debinding allows two or more green parts to be simultaneously debound to produce complex parts thereby eliminating any manipulation of friable brown parts normally used to produce larger sintered final products. This method eliminates the necessity for high precision machining often required for more conventional joining techniques for brown parts, such as brazing or welding. With the present process because the joining of the parts is preceded by an intimate contact and a linkage of the two green parts to be joined, at contact surfaces defining a joint between each green part. This joint completely disappears and its physical structure becomes indistinguishable from of rest of the green part. The subsequent debinding and sintering produce a solid part that is equivalent to one where the joint had never been present. Since the debinding process is required to produce parts, introducing the co-debinding to the process adds almost no cost compared to the joining techniques that are done after debinding.

The co-debinding process has the further advantage that the interconnection of formed green parts, may be a non-permanent connection, thus the connection can be disengaged, if needed. Thus, the green parts although interconnected in an intimate way, are optionally disengageable one from the other, if for example, the green parts were incorrectly positioned or aligned. If the green parts are disengaged, the parts could be once again interconnected in proper alignment. The intimate physical contact between the two green parts furthermore does not require specialized equipment to hold the green parts together in a required shape. Overall all the process affords greater flexibility, simplicity and production cost advantages.

A metal, ceramic or carbide injection powder with a mean particle size generally varying in a range from about 100 μm to about 0.1 μm, and preferably 50 μm to about 0.1 μm is vigorously mixed, or homogenized with a binder. The percentage of injection powder to total feedstock varies based on the type of injection powder, and its physical properties (density, particle size etc.). The percentage injection powder to total feedstock varies typically in a range from 30 to 80% powder solids by volume of the total feedstock mixture, and preferably from 50 to 80% powder solids by volume of total feedstock mixture.

The process can be conducted with different injections powders for individual green parts, where the powders of the connected green parts are a different material. Different materials having different nature and composition can also be used within each green part. If appropriately selected powders can be eliminated or removed from the completed brown part before sintering, thus generating a pre-determined porosity.

The binder can be an organic material which is molten above room temperature (20° C.) but solid or substantially solid at room temperature. The binder may include various components such as surfactants which are known to assist the injection of the feedstock into mold for production of the green part. An example of a good binder is a mixture of a lower and a higher melting temperature polymer or polymers. Table 1 define values for the higher and lower melting temperature polymers, where polymers having a melting temperature below 100° C. are defined a lower melting temperature polymers and above 100° C. are defined as higher temperature melting polymers.

TABLE 1

| Binder | Melting Temperature (° C.) |
|---|---|
| PP—Polypropylene | 150 |
| PE—Polyethylene | 170 |
| PS—Polystyrene | 180 |
| PVC—Polyvinyl Chloride | 180 |
| PW—Paraffin Wax | 60 |
| PEG—Polyethylene glycol | 65 |
| MW—microcrystalline wax | 70 |

Green parts may be prepared in any suitable MIM or PIM methods that would be known to the skilled person. However, rigid and tightly packed substantially non-porous dense green or parts that owe their structural strength to the solid binder are used in a preferred embodiment. The expression substantially non-porous or dense means that most of the spaces between injection powder particulates are filled with solidified binder material and that there is no significant porosity. However, the green parts may be designed to include varying degrees of porosity, thus they may have a planned level of porosity.

Two or more parts are produced as individual green parts from one or more molds. The metal, ceramic and/or carbide powder is mixed with a molten binder and the suspension of injection powder and binder, are injected into a mold, cooled to a temperature below that of the melting point of the binder. Therefore, the binder freezes in the mold thus producing a substantially green part.

Other methods for producing the green parts are also available and include transferring a fully homogenized particulate feedstock into a heated mold where the binder melts and then cooling the mold until the binder solidifies or freezes.

It is understood that this green part once frozen is relatively strong and has a higher resistance to manipulation then that of a brown part, due to the inherent structural stability imparted to it by the binder.

The two green parts are allowed to cool, with the binder and the feedstock freezing. The cooled parts are removed from their respective molds. The green parts are then interconnected in such a way as to produce a particularly close or very intimate contact between the two parts produced. However, because the parts that are being produced require a specific and often intricate shape, the two parts must be linked in a specific orientation. This linkage further maintains the intimate contact at a specific position is required. This linkage also reduces the likelihood that contaminants (primarily from a subsequent shape forming step) find their way into the joint. Thus the interconnection has two steps, the first is the intimate contact and the second the linkage of the parts such that their orientation and contact is maintained.

The interconnection of the green parts may optionally produce an assembly from which the parts may be disconnected or disengaged. This type of interconnected disengageable green assembly affords the process further flexibility of production, that allows the parts to be realigned or reoriented correctly.

The interconnection between the parts may produce a substantially hermetic joint between the two green parts, that can be achieved in a number of ways that can also lead to the successful co-debinding of the two green parts. The substantially hermetic connection is defined as an interconnection between the green parts that is substantially airtight or sealed. Although the hermetic connection is one possible interconnection produced by the described process, the interconnection between the two green parts need not be hermetic to produce the efficient and seamless joining of green parts described herein.

One approach to producing an interconnection of the green parts is by threading, such that the green parts are screwed one into the other. That is, one green part includes a threaded male part adapted to enter a complementarily threaded female part on the second green part. It is well understood that a threaded connection between parts is known to produce a substantially hermetic seal, through a very close and intimate contact between the threads of the two parts. The threaded zones of the two parts are indented or etched into the other part to produce a very tight and substantially hermetic connection. This connection can also be imparted to other, non threaded, areas of the threaded parts and held in connection by the threaded linkage. It is further understood that a threaded connection can be disengaged and refastened such that the orientation of the green parts is changed or other threaded inserts or spacers could be added/removed.

The linkage of the two green parts can be made using other common mechanical connector and/or mechanical locking systems, that include but are not limited to: bolts; clips; clamps; couplings; lugs; pins; and rivets. Each of these connectors can be made of the feedstock or filler feedstock, and designed to engage in a specific orientation. In a preferred embodiment the green parts are designed with complementary engaging clips.

Thus the linkage can be successfully produced in a numerous ways, that are also disengageable, beyond that of threading the two parts together. Other successful linking methods include a chemical linkage that include and are not limited to:

"Brazing" the two green parts together. This is achieved when two green parts placed in contact are "brazed" together by adding a small amount of molten feedstock to seal any gaps between the contact surfaces of the parts; this type of "brazing" operation can also be achieved by dipping at least a portion of one or both of the green contact surfaces into a molten feedstock and then contacting the surface to join the parts together;

"Welding" the two green parts that have been placed together at contact surfaces. This is achieved by heating the green part or parts near the contact surface to melt the binder by means of a localized heat source at the point(s) of contact or the seam of the surfaces of contact between the green parts. Heat sources such as a lasers, heating tools, electrical soldering tools, and the like would produce a seal analogous to welding; and "Sticking" the two parts together. This is achieved by heating at least one of the contact surfaces of the green parts such that the binder within the parts softens, and allows the two greens parts once contacted to produce what is herein referred to as a hermetic seal. This can also be achieved by placing the assembly in a warm oven. In both cases the binder does not melt but only softens.

"Gluing" the two parts together is possible by using a filler feedstock that is melted as a glue. One example of this would be to use a hot glue gun where a glue stick of the glue gun is replaced by a filler feedstock stick. This filler feedstock could be placed along the seam of the joint holding the parts in close and/or hermetic contact.

The filler feedstock may have a second binder, with a different composition such that the filler feedstock has a lower melting point than the feedstock used within the green parts. In this way, the second binder may be liquid or paste-like at the temperature of application within the filler feedstock, while the binder within the green parts, and the feedstock of the green parts themselves remain solid.

Each of the methods of brazing, welding, sticking and gluing are adapted such that they too can be disengaged. This is typically done by limiting the amount and location of the linkage. If disengagement is required these linkage methods may cause somewhat greater damage to the green parts then the common mechanical linkage previously described but with care these linkage too can be used and designed to minimize any damage if the green parts must be disengaged. Clearly, the more of the chemical type of linkage, the more difficult the disengagement.

With the green part sealingly interconnected into an interconnected yet disengageable green assembly, the assembly is immersed into a bed of dried particulate material, such as, alumina ($Al_2O_3$) all within container. The alumina is arranged within the container to surround and envelop the interconnected green assembly. The alumina and assembly are then compacted, typically by vibration, such that the interconnected green assembly is held in place. The compacted alumina thereby produces shape retaining conditions that allows the assembly to retain its shape despite undergoing a wide variation of temperatures and physical changes. It is understood that other particulate materials based on alumina can also be used where various other compounds are also present in the particulate. Various other methods of compacting the particulate material are available, and include impactions The skilled person would understand that other solid particulate material may also be used. The possible particulate materials that may be used to exert the shape retaining conditions on the green assembly include: CaO, MgO, zeolites, bentonite, clays, other metal oxides ($TiO_2$, $ZrO_2$), $SiO_2$, and combinations thereof. Dried and optionally calcined particulates produce the best results. It is however important that the particulate material be easily wetted by at least one of the major binder components in order for the wicking of the binder to take place.

The interconnected assembly is then "co-debound" to remove the binder. The method uses heat to eliminate the binder thermally and the heat further joins the two interconnected parts completely. In the first stage of heating, the binder melts and becomes liquid. At this point, the joining is completed. It has been observed that at this stage, the interface between the physically interconnected green assembly disappears and the two green parts become one. The interaction between the molten liquid and/or gaseous binder and the metal powder causes the physical interface between the interconnected green parts to completely disappear.

The alumina then wicks the molten liquid binder away from the interconnected assembly within itself. In this stage of heating the temperature is raised carefully so as not to vaporized the binder immediately and possibly deform the green assembly due to explosive escape of volatile vapours from with the assembly. The temperature depends on the binder used, the temperature is above the binder's melting temperature and below its boiling temperature.

With the majority of the binder removed as liquid, the remaining binder may be heated at a faster rate and all the binders elements may be vaporized partially or fully.

If the process is stopped before all the binder has been evacuated the interconnected assembly may still be considered a single green assembly. This single green assembly has been partially co-debound, but still includes sufficient binder holding the assembly together. This single green part may be interconnected by physical means once again to another (third) green part to produce an even larger green assembly. In this case the surface of the single green assembly may be reapplied with molten binder or feedstock and allowed to cool before it is physically interconnected to the third green part.

More commonly, one, two, three or more parts are sealingly interconnected, placed under shape retaining conditions, and co-debound completely by heating to eliminate the binder and to produce a brown part assembly or incompletely co-debound to produce a incomplete green assembly.

The incomplete green assembly or brown part assembly is left to cool within the compressed particulate material. Once cooled it is carefully removed from the compacted particulate. It must be remembered that the brown part is friable and held together due to partially incomplete or pre-sintered powder connections.

The final step of this process is conducted in an oven where the brown part assembly is sintered completely to produce the final product. The process of sintering cannot be conducted in solid particulate matter under shape retaining conditions because the brown assembly will shrink upon being sintered.

Example 1

A mixture of metal powder at 60% solids by volume of the total feedstock mixture was prepared with a wax based binder. In this test, a tapered threaded nut and a threaded pipe were produced as individual green parts from separate molds. The metal powder having a mean particle size less than 100 μm was dispersed thoroughly with a molten binder. The dispersion of binder and metal powder was injected into a mold at a temperature below the melting point of the binder, thus freezing the binder in the mold and producing a substantially dense green part.

The two green parts are allowed to cool and are removed from their respective molds and threaded appropriately. The parts are screwed into each other and thus intimately contacted and linked interconnectedly. In this case, a substantially hermetic connection is produced between the two parts.

The interconnected green assembly of parts is immersed into a bed of particulate alumina ($Al_2O_3$). The alumina surrounds and envelopes the physically interconnected green assembly. The alumina is then compressed with sufficient pressure such that the interconnected green assembly is held in place. The compacted alumina allows the shape of the assembly to be retained.

The interconnected assembly is then "co-debound" to produce a single green body and then to eliminate the binder thermally in a two stage heating. In the first stage of heating, the temperature rise is slowly increased, to melt the binder, joint the parts and then slowly evacuate the binder within the alumina by capillarity.

Once the majority of the binder is removed, the second stage allows for a faster rise to a temperature below the metals melting point. The assembly is heated to remove the remaining binder and to produce a brown pre-sintered part.

The brown part is removed from the alumina and sintered. Metallographic analysis was performed on the sample to investigate the quality of the interface between the two parts. This analysis clearly indicated that the interface between the two parts had merge and was no longer present.

Example 2

Two metallic green cylindrical parts were prepared as in Example 1. This time two cylindrical parts having substantially the same diameter were prepared. The two parts were placed into intimate contact with each other, and maintained in place by means of a vice. The two parts were not threaded. The positioning linkage was made by "brazing" the parts together by adding a small amount of molten metal binder feedstock suspension at the joint between the two parts.

The two parts were compacted in alumina as in Example 1 and "co-debound" to produce a brown part.

The brown part was removed from the alumina and sintered. Another metallographic analysis was performed that also clearly showed that the interface between the two parts had merged.

Example 3

An assembly (10) of two dense metal green parts (20, 22) were produced. The parts are schematically represented in FIG. 1. The parts are produced in the shape of steps of a staircase and are engaged to produce an intimate contact at the staircase by placing one green part (22) on top of the other green part (20) as shown in FIG. 1. A laser was used to link the part (20, 22) in the correct position with a surface weld produced all around the assembly at the seam (30) represented by the bold line in FIG. 1. The laser weld linkage at the seam (30) ensures that parts (20, 22) maintain their positions and intimate contact. The weld was limited to the surface of the seam and did not penetrate deep into the joint.

The assembly was then placed into an alumina particulate, compacted and then heated above the melting temperature of the binder and then cooled to limit the wicking of the binder. The body was extracted from the particulate alumina, no binder was found in the alumina and therefore no wicking had taken place. The body was cut in half across the seam. A first half was returned to the alumina and debound as any other injected part would be. The second half of the body was mounted and polished to show that the joint had already disappeared. After debinding and sintering the first half also showed the seamless joining of the two steps.

The above description is meant to be exemplary only, and one skilled in the art will recognize that changes may be made to the embodiments described without departing form the spirit of the invention. Still other modifications which fall within the scope of the present invention will be apparent to those skilled in the art, in light of a review of this disclosure and such modifications are intended to fall within the appended claims.

The invention claimed is:

1. A process for joining powder injection molded parts, the method comprising:

preparing at least two green parts from a feedstock, the feedstock comprising a binder and an injection powder;

placing the at least two green parts in intimate contact while the binder is frozen; maintaining the at least two green parts in intimate contact with a linkage between the at least two green parts along contact surfaces defining a joint between the at least two green parts, to produce an interconnected green assembly;

placing the interconnected green assembly under shape retaining conditions;

producing a seamless brown part from the at least two green parts by first heating the interconnected green assembly to a temperature above the melting point of the binder but below the boiling point thereof, causing the binder to completely melt throughout the at least two green parts to eliminate the joint between the at least two green parts so that at least the two green parts join seamlessly while the binder is in a liquid phase; debinding the joined green parts so formed by removing the majority of the liquid binder away from the seamlessly joined green parts; and a second stage of heating to a temperature above the boiling point to then vaporize all the binder after the joining of the at least two green parts has been completed thus producing a brown part.

2. The process of claim 1, wherein the assembly is disengaged and re-engaged before being placed under shape retaining conditions.

3. The process of claim 1, wherein the maintaining step comprises a mechanical joining of the two green parts.

4. The step process of claim 3 wherein the step of mechanically joining the at least two green parts includes screwing the at least two green parts together at a threaded joint.

5. The process of claim 1, wherein the maintaining step comprises heating at least a small portion of a contact surface of the at least one of the two green parts sufficiently to melt the binder.

6. The process of claim 1, wherein the maintaining step comprises spot welding the at least two green parts using a laser or other heat source.

7. The process of claim 1, wherein the maintaining step comprises heating the at least two green parts to a temperature where they stick to one another without melting.

8. The process of claim 1, wherein the injection powder is a finely divided ceramic, metallic and/or carbide powder.

9. The process of claim 8, wherein the injection powder is a metallic powder.

10. The process of claim 1, wherein the at least two green parts are prepared by:

providing the binder and the injection powder;

thoroughly dispersing the binder and the injection powder together to produce a particulate feedstock;

heating the feedstock to melt the binder to produce the molten feedstock; and freezing the molten feedstock in at least one mould.

11. The process of claim 1, wherein the injection powder for each of the green parts is a different composition.

12. The process of claim 1, wherein the injection powder used for the green parts is a mix of powders of different nature and/or composition.

13. The process as defined in claim 1 wherein the process is stopped before all the binder has been evacuated in the first stage of heating; interconnecting a third green part by physical means to the partially co-debinded assembly to produce a complex green assembly; and placing the complex green assembly in the shape retaining conditions.

14. The process as defined in claim 13 wherein the process of de-binding is resumed.

15. The process as defined in claim 1 wherein the interconnected green assembly is placed within a bed of particulate material and the particulate material is compacted to ensure the shape retaining conditions.

16. The process of claim 15, wherein the solid particulate material is alumina ($Al_2O_3$) or alumina based.

17. The process of claim 15 wherein the solid particulate material is readily wetted by the binder to facilitate the wicking action of the particulate material on the binder.

18. The process as defined in claim 15 wherein the step of debinding the majority of the binder in liquid phase occurs by a wicking action of the bed of particulate material.

19. The process as defined in claim 15 including the further step of pre-sintering the brown part to allow the brown part to retain its shape after debinding.

20. The process as defined in claim 19 including the steps of cooling and then removing the pre-sintered brown part from the shape retaining bed of particulate material; and sintering the brown part.

21. The process as defined in claim 1 including the steps of engaging complementary mating structures provided on said at least two green parts to link the green parts in such a manner as to permit the at least two green parts to be readily disengaged; and verifying the alignment of the at least two green parts and if necessary disengaging and re-engaging the green parts.

* * * * *